US005312194A

United States Patent [19]

Ikehata

[11] Patent Number: 5,312,194

[45] Date of Patent: May 17, 1994

[54] PRINTING HEAD FOR PRINTER

[75] Inventor: Tsutomu Ikehata, Sakado, Japan

[73] Assignee: Citizen Watch Co., Ltd., Tokyo, Japan

[21] Appl. No.: 795,600

[22] Filed: Nov. 21, 1991

[30] Foreign Application Priority Data

Nov. 30, 1990 [JP] Japan ..... 2-126550[U]

[51] Int. Cl.[5] ..... B41J 2/00

[52] U.S. Cl. ..... 400/124; 101/93.05

[58] Field of Search ..... 400/124; 101/93.05, 101/93.04, 93.03

[56] References Cited

U.S. PATENT DOCUMENTS

| | | | |
|---|---|---|---|
| 4,572,681 | 2/1986 | Miyazawa et al. | 400/124 |
| 4,640,633 | 2/1987 | Hebert | 101/93.05 |
| 4,653,943 | 3/1987 | Sakaida et al. | 400/124 |
| 4,795,283 | 1/1989 | Moriya et al. | 400/124 |
| 4,986,676 | 1/1991 | Kimura et al. | 400/124 |
| 5,096,313 | 3/1992 | Horii | 101/93.05 |

FOREIGN PATENT DOCUMENTS

| | | | |
|---|---|---|---|
| 0372557 | 12/1989 | European Pat. Off. | 400/124 |
| 63-106638 | 5/1988 | Japan . | |
| 0145046 | 6/1988 | Japan | 400/124 |
| 63-151844 | 6/1988 | Japan . | |
| 2192956 | 7/1990 | Japan | 400/124 |
| 2200448 | 8/1990 | Japan | 400/124 |
| 2281964 | 11/1990 | Japan | 400/124 |

*Primary Examiner*—Edgar S. Burr
*Assistant Examiner*—Anthony Nguyen
*Attorney, Agent, or Firm*—Lowe, Price, LeBlanc & Becker

[57] ABSTRACT

A printing head for a printer comprises a plurality of armatures arranged radially, a drive section including a plurality of drive units which support outer ends of the respective armatures to swing the same, respectively, a plurality of needles engaged respectively with inner ends of the respective armatures and swingable during swinging movement of the armatures, an armature stopper for limiting strokes of the respective armatures on a side opposite to a side where the needles project, and a plurality of guide elements for guiding respectively the armatures in sliding directions of the needles, the intermediate member has a first step arranged at an outer surface of the intermediate member and a second step arranged at an inner surface of the intermediate member, the first step is directed toward a side where the needles project and are abutted directly or indirectly against armature support surfaces of the drive section, respectively, the second step is directed toward a side opposite to the projecting side of the needles, and the armature stopper is abutted against the second step.

6 Claims, 3 Drawing Sheets

PRINTING HEAD FOR PRINTER

BACKGROUND OF THE INVENTION

1. Field of the Invention

The present invention relates to a printing head for a printer.

2. Description of the Prior Art

A printing head is known from Japanese Utility Model Laid-Open No. 106638/1988 and Japanese Utility Model Laid-Open No. 151844/1988, in which armatures have respective inner ends thereof which are arranged radially on a solenoid base on which a plurality of solenoids are arranged. The inner ends of the respective armatures are swung by exciting of the respective solenoids. During the swinging movement, needles engaged with the inner ends of the respective armatures slide and project from a nose section to perform printing. A stroke of each of the armatures is restricted or limited by the armature stopper at a location opposite to a direction in which the needles project.

In the conventional printing head, since the armature stopper is mounted so as to be abutted against a rear cover which is mounted on an end opposite to the side where the needles project, variation in a stroke of each of the armatures increases by variation in step between the solenoid-base mounting portion of the rear cover and the armature abutment surface of the armature stopper, a thickness of the armature stopper and a thickness of the armature. In order to reduce the variation, operation is required to adjust or regulate the thickness of the armature stopper. Thus, it has been difficult to perform automatic assembling.

SUMMARY OF THE INVENTION

It is an object of the invention to provide a printing head for a printer, in which an air gap is high in accuracy at the time armatures are in respective waiting positions thereof, in which strokes of the respective armatures at the time a plurality of needles operate to project without the needle colliding against an article to be printed are set only by dimensional accuracy of the intermediate member and the armatures, in which variation is low, in which the armatures, an armature stopper, a rear cover and the like can easily be assembled with respect to a solenoid base from one direction without thickness adjustment, and in which automatic assembling can easily be performed.

According to the invention, there is provided a printing head of a printer, comprising:

a plurality of armatures arranged radially;

a drive section including a plurality of drive units which support outer ends of the respective armatures to swing the same, respectively;

a plurality of needles engaged respectively with inner ends of the respective armatures and swingable during swinging movement of the armatures;

an armature stopper for limiting strokes of the respective armatures on a side opposite to a side where the needles project; and an intermediate member having a plurality of guide portions for respectively guiding the armatures in sliding directions of the needles, wherein the intermediate member has a first step arranged at an outer surface of the intermediate member, the first step being directed toward a side where the needles project and being abutted directly or indirectly against armature support surface of the drive section, and a second step arranged at an inner surface of the intermediate member, the second step being directed toward a side opposite to the projecting side of the needles, the armature stopper being abutted against the second step.

The arrangement is such that the first steps provided on the outer surface of the intermediate member is abutted against the armature support surface of the drive section through the protecting plate 18, and the armature stopper is abutted against the second step provided on the inner surface of the intermediate member. With the arrangement, spacing between the upper surface of the protection plate 18 and the armature stopper is decided only by the dimension between the two steps of the intermediate member regardless of dimensional accuracy of the armature stopper and the rear cover. By the dimension in which the distance between both the abutments of the armatures is subtracted from the above spacing, the stoke of the armature is decided. Thus, there is produced a stroke high in accuracy.

Further, it is possible to assemble, easily and highly in accuracy, the distance between the attraction surface of the core in the waiting position where the armatures are abutted against the armature stopper, and the surfaces to be drawn of the respective armatures.

Furthermore, the intermediate member and the armatures are abutted against the solenoid base, and the armature stopper is abutted against the intermediate member, whereby these elements are automatically positioned in this order at assembling.

Accordingly, it is not required to regulate the thickness of the armature stopper at assembling, dissimilarly to the conventional arrangement. Moreover, the armatures and the intermediate member are positioned by the rear surface of the drive section, and the armature stopper is positioned by the intermediate member. Accordingly, it is possible to simply assemble the armatures, the intermediate member and the armature stopper from the forward end toward the rearward end in this order. Thus, automatic assembling is made easy.

DETAILED DESCRIPTION OF THE PREFERRED EMBODIMENT

Figure 1:
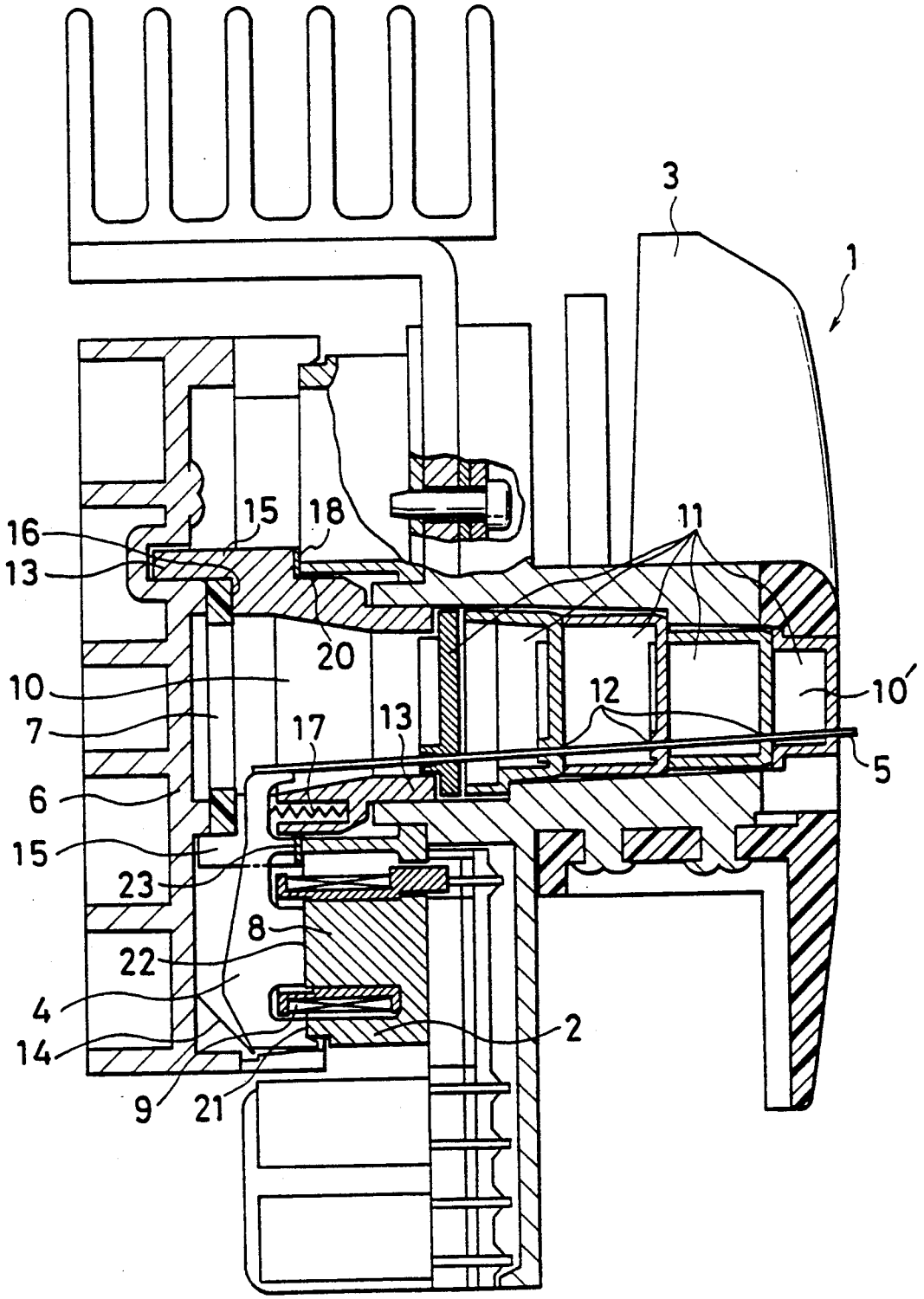
FIG. 1 is a partially cross-sectional front elevational view of a printing head for a printer.
Figure 2:
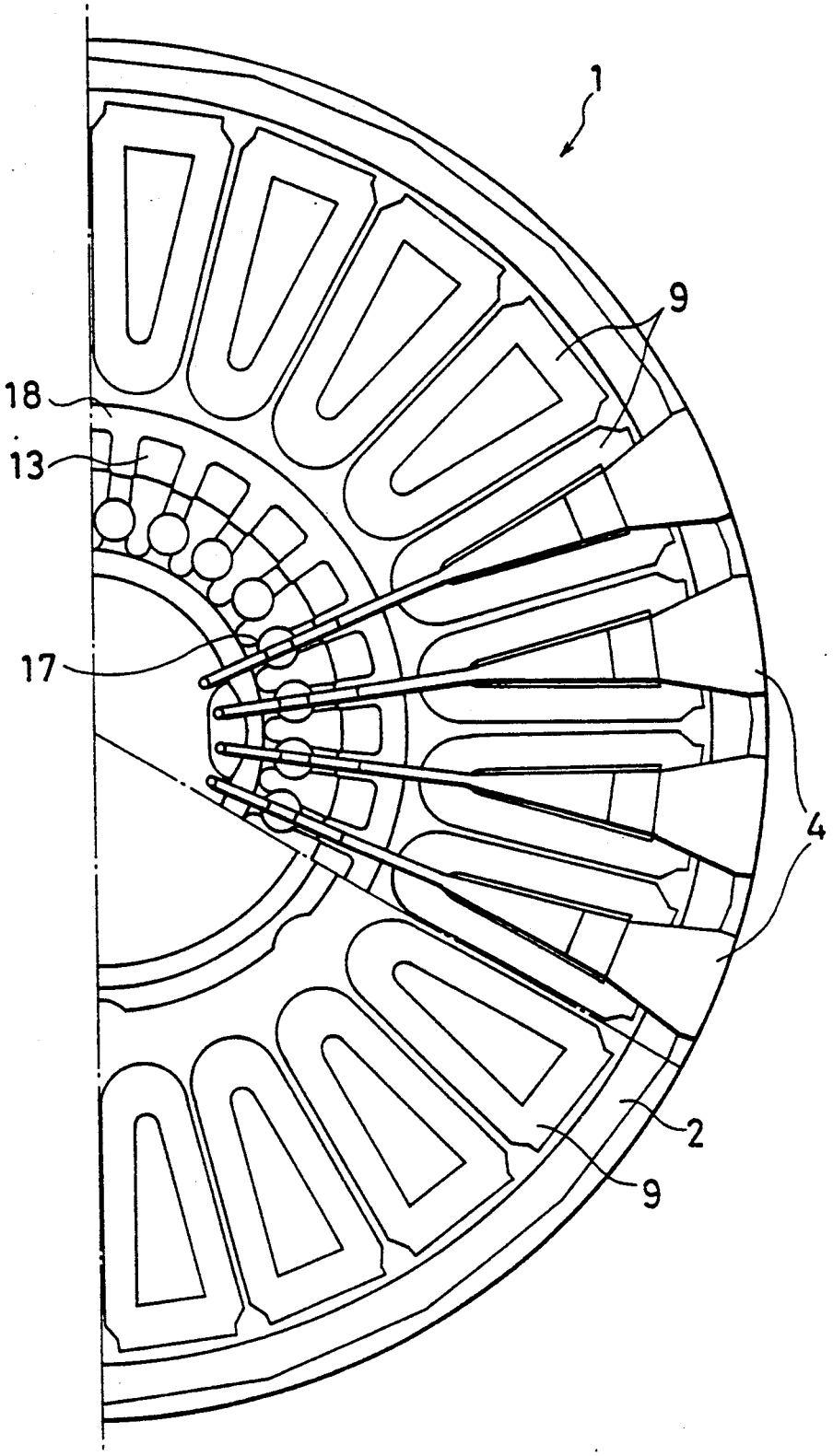
FIG. 2 is a partially cut-away right-hand side elevational view along line 1—1 of FIG. 2, of a principal portion of the printing head for the printer.

Referring first to FIG. 1, which is a cross sectional view of a printing head 1 for a printer along line 1—1 of FIG. 2. The printing head 1 comprises a drive section 2, a nose section 3, a plurality of armatures 4, a plurality of needles 5, a rear cover 6, an armature stopper 7, and an intermediate member 13 forming spring holders, respectively.

The drive section 2 has a plurality of drive unit which include columnar cores 8 arranged at suitable spacing along a peripheral direction, and coils 9 would respectively about the cores 8. The drive section 2 has a center thereof at which a needle receiving cavity 10 is formed. At the side opposite to the nose section 3, the drive section 2 has a plurality of armature support surfaces 21 extending from an outer periphery of the drive section 2 toward an inner periphery thereof, a plurality of armature-attraction end surfaces 22, and a plurality of armature stop surfaces 23. The armature stop surfaces 23 are provided with a protection plate 18, if necessary.

The armature support surfaces 21 at the outer periphery, the end surfaces 22 of the respective cores 8 drawing respectively the armatures 4, and the armature stop surfaces 23 receiving the protection plate 18 serving as stoppers for the respective armatures 4 are formed in the same plane or surface.

The nose section 3 has a center axis, and has a needle receiving cavity 10' extending along the center axis. A plurality of needle guides 11 are arranged within the needle receiving cavity 10' in a superimposed manner along a longitudinal direction. A plurality of needle inserting openings 12 are formed respectively through the needle guides 11.

The drive section 2 and the nose section 3 are mounted such that the needle receiving cavities 10 and 10' are arranged coaxially with each other. The plurality of needles 5 are arranged within the needle receiving cavities 10 and 10' slidably through the needle inserting openings 12.

Further, the armatures 4 are radially arranged respectively at locations corresponding respectively to the cores 8, at the surface of the drive section 2 opposite to the nose section 3, that is, at the rear surface. The armatures 4 have respective outer ends thereof which are urged respectively against the armature support surfaces 21 at the outer periphery of the drive section 2, by leaf springs 14. Inner ends of the respective armatures 4 are supported swingably with the abutting portions serving as fulcrums. The inner ends of the respective armatures 4 are engaged with deep or rear ends of the respective needles 5.

Figure 3:
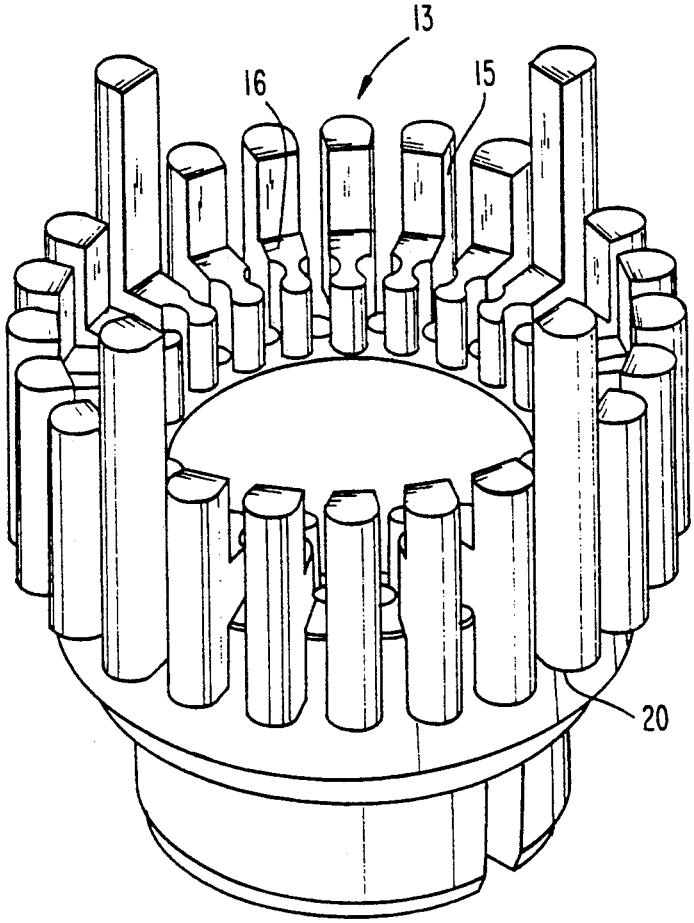
FIG. 3 is a perspective view of a structural element of the embodiment of the invention depicted in FIGS. 1 and 2.

As shown in FIG. 2 and FIG. 3, the intermediate member 13 is generally in the form of an annulus and has a plurality of guide portions. Referring back to FIG. 1, first step 20 arranged on an outer surface of the intermediate member 13 and facing toward the projecting sides of the respective needles 5 is supported through the protection plate 18 by the armature stop surfaces 23. The protection plate 18 is arranged along the inner periphery of the rear surface of the drive section 2, and can be omitted depending upon the material of an impinging or collision section. The armature stop surfaces 23 are formed in the same plane as an armature attraction surface 22 of the drive section 2.

The first step 20 is mounted so as to be fitted in the drive section 2. The intermediate member 13 has a forward end which is fitted in the nose section 3. In this connection, a distance between the attraction surface of the core section at the time the armatures 4 are drawn, and surfaces to be drawn of the respective armatures is decided or determined depending upon a thickness of the protection plate 18. Gaps are required to facilitate movement toward and away from each other. The intermediate member 13 has a rear surface thereof. At the rear surface of the intermediate member 13, a plurality of projections 15 for limiting movement of the respective armatures 4 in the circumferential direction are arranged respectively at locations corresponding respectively to the gaps between the cores 8, and are fitted in the rear cover 6. Furthermore, the projections 15 have respective inner surfaces which are formed with a second step 16 located at a position opposite to the projecting side of the needles 5 which are low in one step. Return springs 17 for biasing the respective armatures 4 toward a direction opposite to the nose section 3 are received respectively between the adjacent projections 15. Moreover, the surfaces to be drawn of the respective armatures 4 and the abutment surfaces thereof with respect to the protection plate 18 are formed as the same plane.

The armature stopper 7 for limiting strokes of the respective armatures 4 is arranged at the rear surface of the intermediate member 13 so as to be abutted against the second step 16. Further, the rear cover 6 is mounted on the rear surface of the armature stopper 7 so as to be abutted thereagainst.

Accordingly, a distance between the attraction surfaces of the respective cores 8 under a waiting condition in which the armatures 4 are abutted against the armature stopper 7 by action of the respective springs 17, and the surfaces to be drawn of the respective armatures 4 is decided depending upon a value in which a size or dimension from the surfaces to be drawn of the respective armatures 4 to the stopper abutment surface is subtracted from a size in which the thickness of the protection plate 18 is added to the distance between the first step 20 and the second step 16 of the intermediate member 13. Furthermore, the stroke of each of the armatures 4 is decided depending upon a distance in which a thickness of a portion of the armature 4 located between the abutment surface of the armature stopper 7 with respect to the armature 4 and the abutment surface of the protection plate 18 with respect to the armature 4 is subtracted from a distance between the abutment surface of the armature stopper 7 and the abutment surface of the protection plate 18.

Operation of the printing head 1 will next be described. When the drive units arranged at the drive section 2 are not energized, the armatures 4 are urged toward the rear cover 6 by the biasing forces of the respective return springs 17, and are abutted against the armature stopper 7. The needles 5 connected to the armatures 4 are retracted into the nose section 3.

When any one of the drive units is energized, an attracting force of the core section causes the armature 4 corresponding to the drive unit, to be moved against the biasing force of the corresponding return spring 17. The surface to be drawn is attracted to a location adjacent to the location where the surface to be drawn is abutted against the attraction surface of the corresponding core. The corresponding needle 5 engaged with the armature 4 is advanced or moved forwardly within the needle receiving cavities 10 and 10', and projects from the nose section 3 to perform printing operation.

When the attraction force of the drive unit disappears or is nullified, the armature 4 is returned toward the rear cover 6 by the biasing force of the return spring 17, and collides against the armature stopper 7 so that the armature 4 stops.

Accordingly, swinging movement of each of the armatures 4 is restricted or limited by the protection plate 18 and the front surface of the armature stopper 7. The stroke of the armature 4 is determined depending upon the distance in which the thickness of a portion of the armature 4 between both the surfaces is retracted from the distance between both the surfaces, that is, the distance in which the thickness of the portion of the armature 4 between the abutment surface of the intermediate member 13 with respect to the protection plate 18 and the second step 16 is subtracted from the distance between the abutment surface of the intermediate member 13 and the second step 16.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A printing head for a printer, comprising:

a plurality of armatures arranged radially, each of said plurality of armatures being supported to swingably move in a stroke;

a drive section including a plurality of drive units with armature support surfaces each supporting a respective one of said plurality of armatures, wherein each of said plurality of drive units swings a respective one of said plurality of armatures;

a plurality of needles engaged respectively with inner ends of said plurality of armatures and slidably moveable to project in a first direction in response to said strokes of said armatures;

an armature stopper for limiting strokes of the respective armatures in a second direction opposite to said first direction; and an intermediate member having a plurality of guide portions for respectively guiding said armatures in sliding directions of said needles, wherein said intermediate member is formed to have a first step arranged at an outer surface of said intermediate member, said first step being in a plane that is substantially orthogonal to said first and second directions of movement of said needles and is coplanar with said armature support surfaces of said drive section, said first step determining a first limit of motion of said armature in said first direction, and a second step arranged at an inner surface of the intermediate member, said second step being in a plane that is substantially orthogonal to said first and second directions of movement of said needles, said armature stopper being abutted against said second step, said second step determining a second limit of motion of said armature in said second direction.

2. A printing head for a printer, according to claim 1, wherein said armature support surfaces of said drive section are formed to be substantially coplanar with an attraction surface of a core section.

3. A printing head for a printer, according to claim 1, wherein springs biasing respectively said armatures are received respectively in said guide portions of said intermediate member.

4. A printing head for a printer, according to claim 1, wherein said intermediate member is fitted in a nose section.

5. A printing head for a printer, according to claim 1, wherein a rear cover is abutted against said armature stopper.

6. A printing head for a printer, according to claim 1, wherein said rear cover and said intermediate member are fitted in each other.

* * * * *